US005875553A

United States Patent [19]

Geib, Jr. et al.

[11] Patent Number: 5,875,553

[45] Date of Patent: Mar. 2, 1999

[54] DUAL SCISSORS APPARATUS

[76] Inventors: Edward M. Geib, Jr., 4700 Hall Rd., Orlando, Fla. 32817; Hidemi Adachi, 489-1 Hiromi, Seki City, Gitupref, Japan

[21] Appl. No.: 842,247

[22] Filed: Apr. 23, 1997

[51] Int. Cl.[6] ..... B26B 13/00

[52] U.S. Cl. ..... 30/226; 30/195; 30/254

[58] Field of Search ..... 30/226, 227, 254, 30/260, 194, 195

[56] References Cited

U.S. PATENT DOCUMENTS

| | | | |
|---|---|---|---|
| D. 267,996 | 2/1983 | Kowalski | 30/226 X |
| 550,483 | 11/1895 | Carrier | 30/226 X |
| 1,012,918 | 12/1911 | Roelants et al. | 30/227 |
| 1,715,898 | 6/1929 | Carrie | 30/227 |
| 2,682,108 | 6/1954 | Shaler | 30/260 X |
| 2,840,905 | 7/1958 | Geiger | 30/226 |
| 5,600,891 | 2/1997 | Orgal | 30/260 X |

*Primary Examiner*—Douglas D. Watts
*Attorney, Agent, or Firm*—Holland & Knight LLP

[57] ABSTRACT

A hair styling apparatus is provided which includes a hair thinning scissors and a hair cutting scissors releasably interconnected to one another at a common pivot point and secured together by a connector device to prevent relative movement so that a hair stylist can manipulate both scissors with precision to simultaneously thin and cut the hair of an individual while permitting disengagement of the two scissors for separate use, easy cleaning and/or substitution of one scissors for another.

14 Claims, 2 Drawing Sheets

DUAL SCISSORS APPARATUS

FIELD OF THE INVENTION

This invention relates to a scissors apparatus, and, more particularly, to the combination of a thinning scissors and a cutting scissors which are pivotally interconnected and releasably secured to one another to allow a hair stylist to perform both a hair thinning and cutting operations simultaneously or to separate the scissors from one another and perform such operations in sequence.

BACKGROUND OF THE INVENTION

Hair stylists have historically used two different types of scissors to cut and style hair. Thinning scissors are typically employed with people having thick or dense hair to "thin out" or reduce the density of hair in one or more areas along the scalp which allows the remaining hair to more readily lie in the desired position. Scissors of this type include cooperating cutting blades wherein one of the blades is formed with serrations along its length. The other type of scissors typically employed in hair styling operations is the standard cutting scissors in which two cooperating cutting blades slidably engage one another with the hair therebetween to cut the hair to length.

Thinning scissors and cutting scissors are often used sequentially in a hair styling operation, typically to first thin the hair and then cut it to length. These two separate operations lengthen the time required to style the hair of an individual, which, in turn, reduces the total number of customers a stylist can accommodate in a given time period.

It is believed that some stylists have attempted to perform the hair thinning and hair cutting operations simultaneously in order to speed up the styling operation. This has been accomplished by grasping the finger rings of a thinning scissors and a cutting scissors, so that they are oriented parallel to one another, and then attempting to manipulate both scissors simultaneously to thin and cut the hair at the same time. Unfortunately, it has proven extremely difficult to control two independent scissors by grasping them at their fingers rings and opening and closing them simultaneously. The scissors tend to slide relative to one another, and the stylist has great difficulty in controlling their movement. As a result, the thinning and cutting operations must be performed slowly to avoid error, and little if any time savings is realized.

In order to avoid relative movement between thinning scissors and cutting scissors used simultaneously, it is also known to essentially permanently interconnect such scissors at a common pivot point so they can be manipulated in tandem. Although this arrangement enhances control of the two scissors by the stylist, the scissors cannot be readily disconnected from one another for cleaning, for use separately and/or to substitute one type of thinning scissors for another.

SUMMARY OF THE INVENTION

It is therefore among the objectives of this invention to provide a hair cutting apparatus which permits hair thinning and hair cutting operations and be performed simultaneously at normal speed and with precision, which allows for easy cleaning of the scissors and which facilitates replacement of one scissors for another, as desired.

These objectives are accomplished in a hair cutting apparatus which includes a hair thinning scissors and a hair cutting scissors releasably interconnected to one another at a common pivot point, and secured together by a connector device to prevent relative movement so that a hair stylist can manipulate both scissors with precision while permitting disengagement of the two scissors for separate use, cleaning and/or substitution of one scissors for another.

In one presently preferred embodiment, a thinning scissors and a cutting scissors are oriented parallel to one another and pivotally interconnected by a pivot assembly. The pivot assembly includes a pivot pin extending through both cutting members of the thinning scissors which is formed with an extension pivotally received within a seat carried by the cutting scissors. Articulation between the pivot pin extension and seat permits smooth and positive, pivotal movement of the two scissors during a cutting operation, with such scissors being separated a distance approximately equal to the length of the pin. In order to maintain the thinning scissors and cutting scissors in engagement with one another, a connector device in the form of a clip or clamp is releasably secured between the base portion of the thinning scissors and the adjacent base portion of the cutting scissors. This clip prevents relative movement of the two scissors, except at the pivot point therebetween, to provide overall stability and allow the stylist to manipulate both scissors simultaneously with precision.

In the embodiment described above, the two scissors are oriented parallel to one another and separated by a distance substantially equal to the length of the pin of the pivot assembly. In order to provide for enhanced feel and comfort in the use of the scissors apparatus of this invention when both scissors are employed together in a styling operation, an alternative embodiment is provided wherein one of the thinning scissors and cutting scissors is formed with a base portion which tapers outwardly from its finger hole to the cutting blades. Essentially, the same pivot assembly described above is employed, but when the thinning scissors and cutting scissors of this embodiment are pivotally interconnected, the finger rings of both scissors are located immediately adjacent one another instead of being spaced apart as in the previously described embodiment. Preferably, the two scissors of this embodiment are releasably secured to one another by at least one pin extending from the base portion of one scissors into a bore formed in the base portion of the other scissors, instead of a clip as in the previous embodiment.

In both of the embodiments of this invention, a combination thinning scissors and cutting scissors apparatus is provided which enables the stylist to perform both thinning and cutting operations at the same time. The two scissors are pivotally interconnected to one another and held in engagement along the base portions thereof to prevent relative sliding motion of the scissors during a styling operation. By allowing the stylist to simultaneously perform both thinning and cutting operations, the overall time required to accommodate an individual is reduced, thus permitting the stylist to service more customers in a given time period. In addition, the two scissors are readily separated from one another by removing the connector device for ease of cleaning, or use of each scissors individually or to substitute one type of scissors for another.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
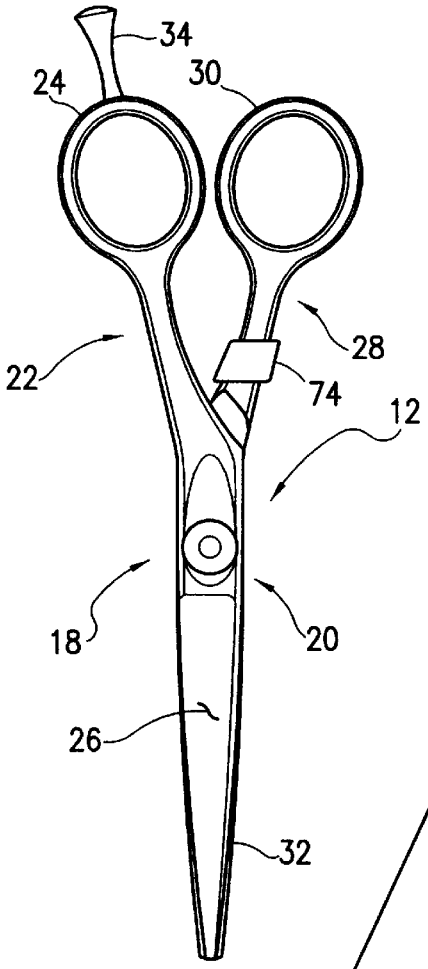
FIG. 1 is a front view of one embodiment of the cutting scissors of this invention.
Figure 3:
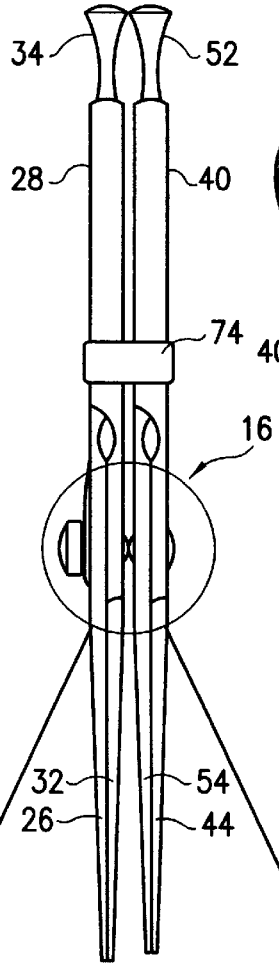
FIG. 3 is a side view of a cutting scissors and thinning scissors connected together.
Figure 2:
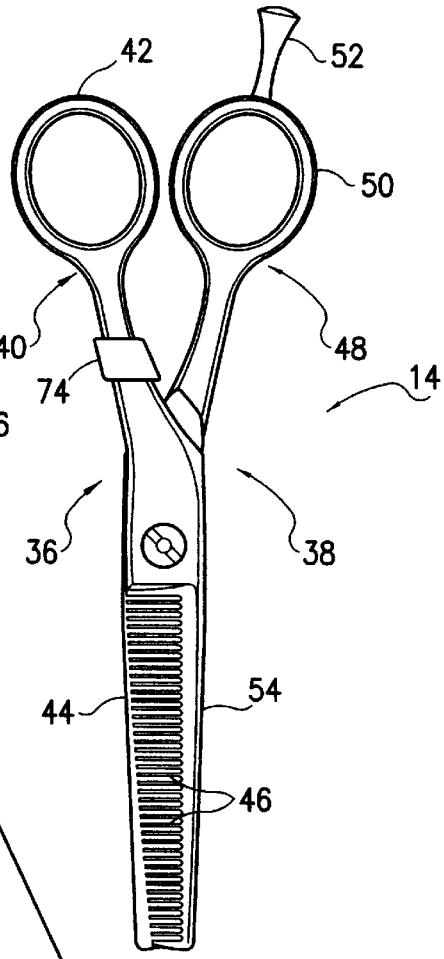
FIG. 2 is a front view of the thinning scissors herein.

Referring initially to FIGS. 1–3, one embodiment of a hair cutting apparatus 10 is illustrated which includes the combination of a cutting scissors 12 and a thinning scissors 14 which are pivotally interconnected by a pivot assembly 16. The cutting scissors 12 conventionally includes a pair of opposed side members 18 and 20. The side member 18 includes a base portion 22 having one end formed with a finger ring 24 and its opposite end joined to a cutting blade 26. Similarly, the side member 20 includes a base portion 28 terminating at a finger ring 30 and joined to a cutting blade 32 which slidably engages the cutting blade 26 to sever hair positioned therebetween. Preferably, the finger ring 24 has an extension 34 to provide a rest for another finger of the hand of the stylist.

The thinning scissors 14 includes side members 36 and 38. Side member 36 has a base portion 40 formed with a finger ring 42 at one end and joined at its opposite end to a cutting blade 44. This cutting blade 44 actually performs a thinning function in operation, and has a serrated configuration comprising a number of extensions or teeth 46 which are oriented side-by-side and spaced from one another along the length of the cutting blade 44. The side member 38 has a base portion 48 including one end which terminates with a finger ring 50 including an extension 52, and an opposite end joined to a cutting blade 54. The cutting blades 44, 54 are slidably engageable with one another to thin or reduce the density of hair captured therebetween.

Figure 7:
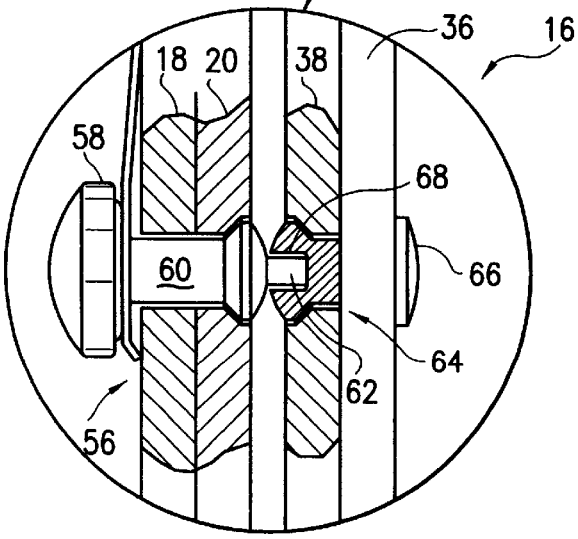
FIG. 7 is a view in partial cross-section of one embodiment of the pivot assembly of this invention employed with the apparatus shown in FIG. 3.

As noted above, the cutting scissors 12 and thinning scissors 14 are pivotally interconnected by a pivot assembly 16. With reference to FIG. 7, one embodiment of the pivot assembly 16 comprises a pivot pin 56 having a head section 58 and stem section 60 which terminates at a reduced diameter, cylindrical extension 62. As depicted in FIGS. 1 and 7, the pivot pin 56 extends through approximately the center of cutting scissors 12, e.g., through both of its side members 18, 20, such that the head section 58 rests against the side member 18 and the cylindrical extension 62 of stem section 60 protrudes beyond the side member 20. The pivot assembly 16 also includes a seat 64 having a head 66 at one end and a cylindrical recess 68 at the opposite end. The seat 64 extends through both the side members 36, 38 of thinning scissors 14 in position such that its head 66 rests against the side member 36 and the cylindrical recess 68 is placed in a position to receive the cylindrical extension 62 of the pivot pin 56.

Figure 8:
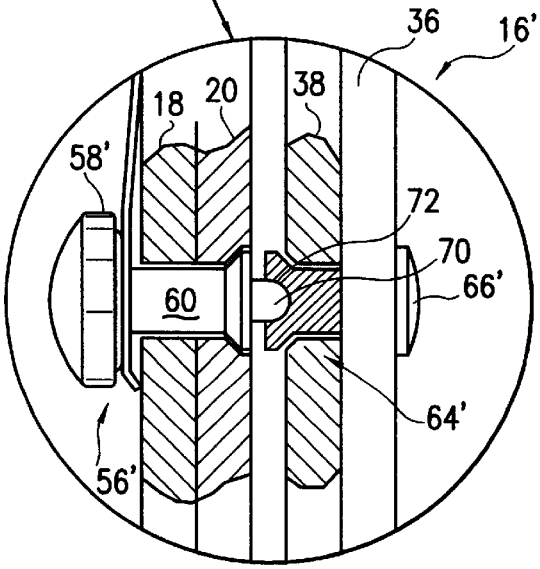
FIG. 8 is an enlarged view in partial cross-section of an alternative embodiment of the pivot assembly of FIG. 7.

With reference to FIG. 8, a variant of the pivot assembly 16 shown in FIG. 7 is depicted. This pivot assembly 16' has essentially the same construction as pivot assembly 16 except for the shape of the elements of the pivot pin 56' and seat 64' which engage one another. As such, structure depicted in FIG. 8 which is common to that in FIG. 7 is given the same reference number with the addition of the "'". In order to provide for some degree of enhanced articulation between the pivot pin 56' and seat 64', compared to the embodiment of FIG. 7, the pivot assembly 16' of FIG. 8 employs a spherical-shaped extension 70 connected to the stem section 60' of pivot pin 56', which is received within a generally semicircular-shaped recess 72 formed in the seat 64'. Otherwise, the pivot assembly 16' is structurally and functionally the same as pivot assembly 16.

In the embodiment of FIGS. 1–3, the cutting scissors 12 and thinning scissors 14 are oriented parallel to one another and separated by a distance approximately equal to the length of the cylindrical extension 62 of pivot pin 56 (see FIG. 3). In order to prevent relative motion between scissors 12 and 14, a connector device in the form of a clamp or clip 74 extends between the base portion 28 of side member 20 of scissors 12, and the base portion 40 of side member 36 of scissors 14. The clip 74 is essentially U-shaped and fictionally engages the side members 20, 36 so as to avoid separation between the scissors 12 and 14 at the pivot assembly 16. It should be noted that in the presently preferred embodiment, the pivots pins 56 or 56' readily disengage from their respective seats 64, 64' to permit separation of the scissors 12 and 14 for cleaning. As such, the purpose of the pivot assembly 16 or 16' is to permit smooth pivotal motion between the scissors 12, 14, whereas the connector device or clip 74 prevents separation therebetween. Consequently, the two scissors 12, 14 can be readily separated from one another by removing the clip 74 so that they can be used individually in separate cutting and thinning operations, and/or easily cleaned, and/or to permit the substitution of a new scissors for one of the scissors 12 or 14. For example, a thing scissors (not shown) employing a different number of teeth can be substituted for thinning scissors 14 to vary the thinning operation performed.

Figure 5:
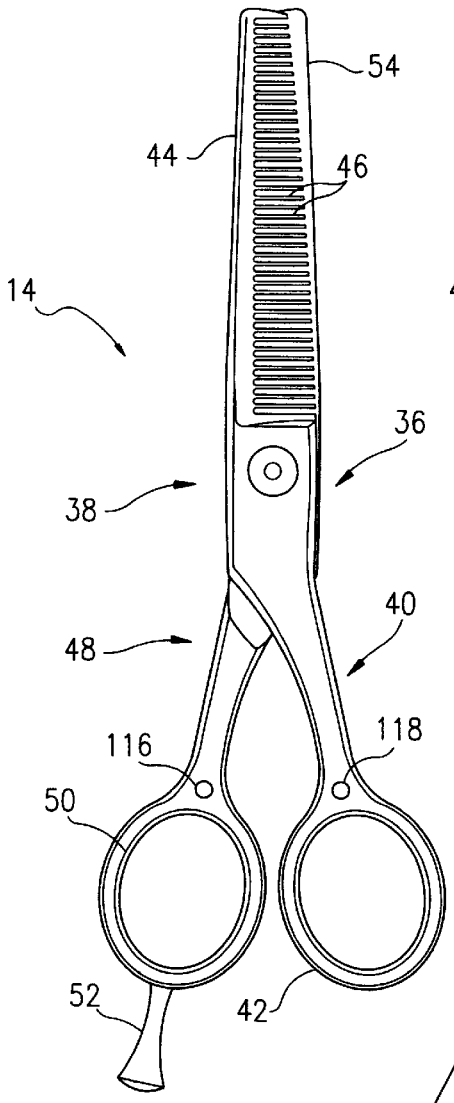
FIG. 5 is a view similar to FIG. 2 of the thinning scissors.
Figure 4:
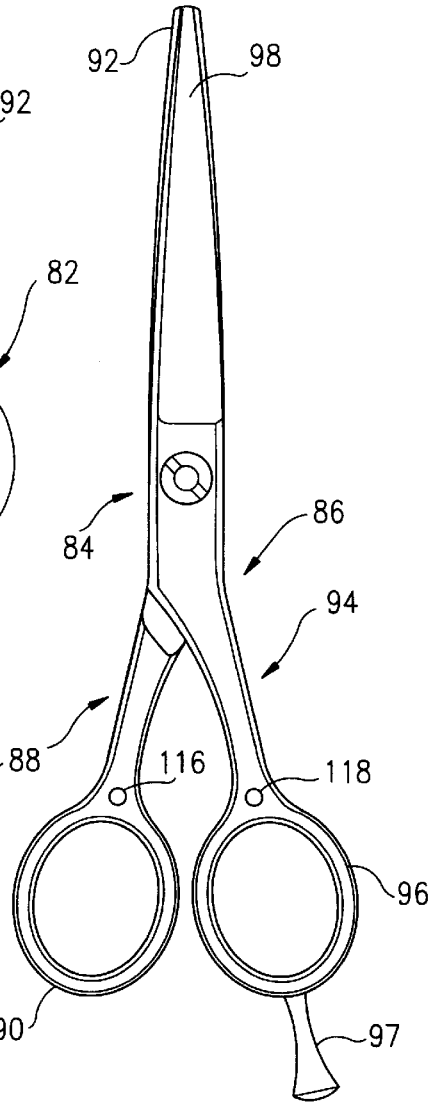
FIG. 4 is a front view of an alternative embodiment of the cutting scissors herein.
Figure 9:
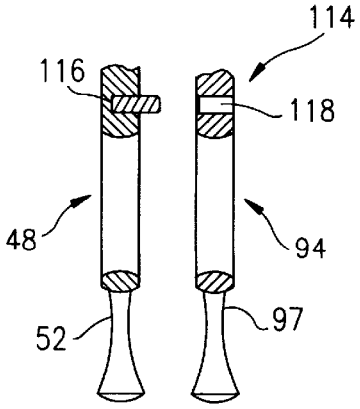
FIG. 9 is an enlarged view in partial cross-section of the structure for releasably connecting the cutting scissors and thinning scissors of FIGS. 4 and 5.

Referring now to FIGS. 4–5 and 9, an alternative embodiment of a haircutting apparatus 76 according to this invention is illustrated. The apparatus 76 employs essentially the same thinning scissors 14 described above, but a modified cutting scissors 80 and pivot assembly 82. For purposes of the present discussion, the same reference numbers used above to describe the thinning scissors 14 in connection with a discussion of FIG. 2, are employed in FIG. 5. The cutting scissors 80 and pivot assembly 82 are described separately below.

Figure 6:
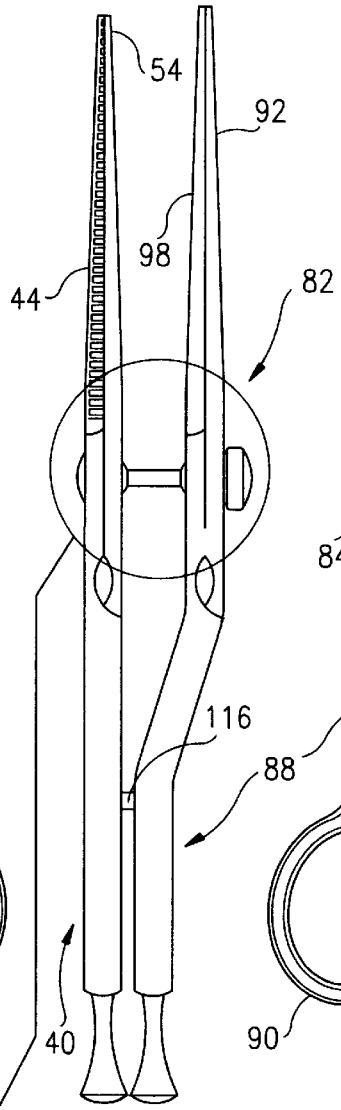
FIG. 6 is a side view of the combination of the cutting scissors and thinning scissors depicted in FIGS. 4 and 5.

The cutting scissors 80 include a pair of side members 84 and 86. The side member 84 has a base portion 88 whose one end terminates with a finger ring 90, and the opposite end of which is connected to a cutting blade 92. As best shown in FIG. 6, the base portion 88 of side member 84 is offset or tapers in an "outward" direction at a point extending from its finger ring 90 to the cutting blade 92. The term "outward" as employed herein refers to a direction away from the thinning scissors 14 when the cutting scissors 80 and thinning scissors 14 are pivotally interconnected as depicted in FIG. 6. The side member 86 of cutting scissors 80 is similarly constructed. It includes a base portion 94 having a finger ring 96 at one end connected to an extension 97. The opposite end of base portion 94 is joined to a cutting blade 98. The base portion 94 of side member 86 has the identical offset as side member 84 so that the finger rings 90 and 96 are oriented in the same plane, and the cutting blades 92, 98 are coplanar.

Figure 10:
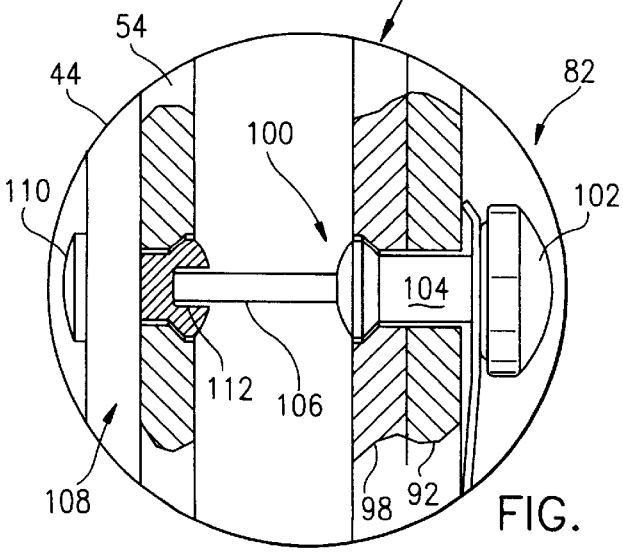
FIG. 10 is an enlarged view of one embodiment of the pivot assembly for interconnecting the scissors of FIGS. 4 and 5.

With reference to FIG. 10, the pivot assembly 82 of apparatus 76 is operationally similar to pivot assembly 16, but has a different length dimension. Pivot assembly 82 comprises a pivot pin 100 having a head section 102 and an elongated stem section 104 compared to the stem section 60 of pivot assembly 16. The stem section 104 terminates with a cylindrical extension 106 as shown in FIG. 10, or, alternatively, a spherical-shaped extension (not shown) of the type depicted in FIG. 8. The pivot pin 100 is carried by cutting scissors 80 in the same manner as described above in connection with cutting scissors 12. The pivot assembly 82 also includes a seat 108 having a head section 110 which rests against the side member 38 of thinning scissors 14. The opposite end of seat 108 is formed with a recess 112 which is cylindrical-shaped in FIG. 10, but can also be semicircular in shape such as the recess 72 of seat 64' in FIG. 8. As shown in FIG. 6, the stem section 104 of pivot pin 100 is elongated to account for the offset in the side members 84, 86.

The purpose of providing the offset in side members 84, 86 is so that when the cutting scissors 80 and thinning scissors 14 are interconnected at the pivot assembly 82, the finger rings 90 and 96 of cutting scissors 80 abut the finger rings 42 and 50 of thinning scissors 14. This provides added control and comfort for the stylist compared to the FIGS. 1–3 embodiment where the cutting scissors 12 and thinning scissors 14 are spaced from one another. In order to releasably connect the cutting scissors 80 and thinning scissors 14, the connector device 114 depicted in FIG. 9 is employed. In the presently preferred embodiment, the connector device 114 comprises a pin 116 carried by the base portion 88 of cutting scissors 80 and a mating throughbore 118 formed in the base portion 40 of the thinning scissors 14. Most preferably, the connector device 114 also includes a pin 116 carried by the base portion 48 of thinning scissors 14 and a bore 118 formed in the base portion 94 of cutting scissors 80. Consequently, when the two scissors 14 and 80 are interconnected at the pivot assembly 82 and placed side-by-side, the two pins 116 are received within their respective bores 118 to securely, yet releasably, mount the scissors 14, 80 together for a cutting operation.

While the invention has been described with reference to a preferred embodiment, it will be understood by those skilled in the art that various changes may be made and equivalents may be substituted for elements thereof without departing from the scope of the invention. In addition, many modification may be made to adapt a particular situation or material to the teachings of the invention without departing from the essential scope thereof. For example, the apparatus 76 depicted in FIGS. 4–6 includes a cutting scissors 80 having offset side members 84 and 86 while the side members 36 and 38 of thinning scissors 14 are essentially planar with no offset. It is contemplated, however, that the reverse arrangement could be employed wherein the side members 36, 38 of thinning scissors 14 are formed with an offset, and cutting scissors 12 of the type shown in FIGS. 1–3 are employed therewith.

Therefore, it is intended that the invention not be limited to the particular embodiment disclosed as the best mode contemplated for carrying out this invention, but that the invention will include all embodiments falling within the scope of the appended claims.

We claim:

1. A hair styling apparatus, comprising:

a first scissors including opposed side members each having a base portion with a finger ring at one end and a cutting blade which is joined to the other end of said base portion, said cutting blade of one side member being slidably engageable with said cutting blade of said other side member to cut hair therebetween;

a second scissors including opposed side members each having a base portion with a finger ring at one end and a cutting blade which is joined to the other end of said base portion, said cutting blade of one side member being slidably engageable with said cutting blade of said other side member to cut hair therebetween;

a pivot assembly effective to pivotally and releasably interconnect said first and second scissors, said pivot assembly including a pivot pin carried by said first scissors which is pivotally received within a seat carried by said second scissors;

a connector device extending between said at least one side member of said first scissors and at least one side member of said second scissors to substantially prevent disengagement of said first and second scissors during a hair styling operation and to otherwise allow disengagement of said first and second scissors.

2. The apparatus of claim 1 in which one of said first and second scissors is a cutting scissors and the other is a thinning scissors.

3. The apparatus of claim 1 in which said cutting blade of one of said side members of one of said first and second scissors is formed with serrations.

4. The apparatus of claim 1 in which said pivot pin has a head section connected to a stem section which terminates in a cylindrical extension, said seat being formed with a cylindrical recess which pivotally receives said cylindrical extension.

5. The apparatus of claim 1 in which said pivot pin has a head section connected to a stem section which terminates in a spherical-shaped extension, said seat being formed with a semi-circular shaped recess which pivotally receives said spherical-shaped extension.

6. The apparatus of claim 1 in which said connector device is a clamp releasably mounted to said base portion of one of said side members of said first scissors and said base portion of one of said side members of said second scissors.

7. A hair styling apparatus, comprising:

a first scissors including opposed side members each having a base portion with a finger ring at one end and a cutting blade which is joined to the other end of said base portion, said cutting blade of one side member being slidably engageable with said cutting blade of said other side member to cut hair therebetween;

a second scissors including opposed first and second side members each having a base portion with a finger ring at one end and a cutting blade which is joined to the other end of said base portion, said first side member having its base portion and cutting blade in substantially the same plane and said second side member having a base portion which tapers in a direction away from said first side member from a location adjacent said finger ring to the juncture of said base portion with said cutting blade thereof;

a pivot assembly effective to pivotally and releasably interconnect said first and second scissors, said pivot assembly including a pivot pin carried by said first scissors which is pivotally received within a seat carried by said second scissors;

a connector device extending between at least one side member of said first scissors and at least one of said first and second side members of said second scissors to substantially prevent disengagement of said first and second scissors during a hair styling operation and to otherwise allow disengagement of said first and second scissors.

8. The apparatus of claim 7 in which one of said first and second scissors is a cutting scissors and the other is a thinning scissors.

9. The apparatus of claim 7 in which said cutting blade of one of said side members of one of said first and second scissors is formed with serrations.

10. The apparatus of claim 7 in which said pivot pin has a head section connected to a stem section which terminates in one of a cylindrical extension and a spherical-shaped extension, said seat being formed with one of a cylindrical recess and a semi-circular shaped recess which pivotally receives said extension.

11. The apparatus of claim 7 in which said first and second side members are substantially parallel to one another along said finger ring of said base portion thereof, and said first and second side members are substantially parallel to one another along said cutting blades thereof, said tapered portion of said base portion of said second side member extending between said finger ring and said cutting blade thereof.

12. The apparatus of claim 11 in which said pivot pin of said pivot assembly has a length, the extent of said tapered portion of said base portion of said second side member between said finger ring and said cutting blade thereof being substantially equal to said length of said pivot pin.

13. The apparatus of claim 7 in which said connector device includes a pin carried by the base portion of at least one of said side members of said first scissors, and a bore formed in one of said first and second side members of said second scissors, said pin being insertable within said bore to prevent disengagement of said first and second scissors during a hair styling operation.

14. The apparatus of claim 13 in which one of said side members of said first scissors is formed with a bore and the other carries a pin, and wherein one of said first and second side members of said second scissors is formed with a bore and the other carries a pin, said pin of said first scissors being engageable with said bore of said second scissors and said pin of said second scissors being engageable with said bore of said first scissors to prevent disengagement of said first and second scissors during a hair styling operation.

* * * * *